United States Patent [19]

Malm

[11] 4,064,363

[45] Dec. 20, 1977

[54] VOCODER SYSTEMS PROVIDING WAVE FORM ANALYSIS AND SYNTHESIS USING FOURIER TRANSFORM REPRESENTATIVE SIGNALS

[75] Inventor: Robert Edward Malm, Los Angeles, Calif.

[73] Assignee: Northrop Corporation, Los Angeles, Calif.

[21] Appl. No.: 689,332

[22] Filed: May 24, 1976

Related U.S. Application Data

[63] Continuation-in-part of Ser. No. 491,928, July 25, 1974, abandoned.

[51] Int. Cl.[2] ..... G10L 1/00

[52] U.S. Cl. ..... 179/1 SA

[58] Field of Search ..... 179/1 SA

[56] References Cited

U.S. PATENT DOCUMENTS

| | | | |
|---|---|---|---|
| 3,026,375 | 3/1962 | Graham | 179/1 SA |
| 3,344,349 | 9/1967 | Schroeder | 324/77 |
| 3,360,610 | 12/1967 | Flanagan | 179/1 SA |
| 3,403,227 | 9/1968 | Malm | 179/1 SA |
| 3,471,648 | 10/1969 | Miller | 179/1 SA |

OTHER PUBLICATIONS

J. Flanagan, "Speech Analysis and Perception", 2nd Ed., Springer-Verlag, 1972, pp. 395-397.

R. Freudberg et al., "An All-Digital Pitch Excited Vocoder etc.", Conference on Speech Comm. and Proc., 1967.

*Primary Examiner*—Kathleen H. Claffy
*Assistant Examiner*—E. S. Kemeny
*Attorney, Agent, or Firm*—Edward A. Sokolski

[57] ABSTRACT

A voice-excited vocoder analyzer divides the audio input signals into a baseband and upper band by deriving Fourier transform coefficients and transmitting the coefficients in a time-multiplex frame. The coefficients ($a_n$ and $b_n$) are derived in two paths, each path multiplying the input signal by a stepped-frequency local source, (one sine, one cosine), the product feeding a recirculating shift register. The vocoder synthesizer effectively performs the same operations in reverse.

21 Claims, 11 Drawing Figures

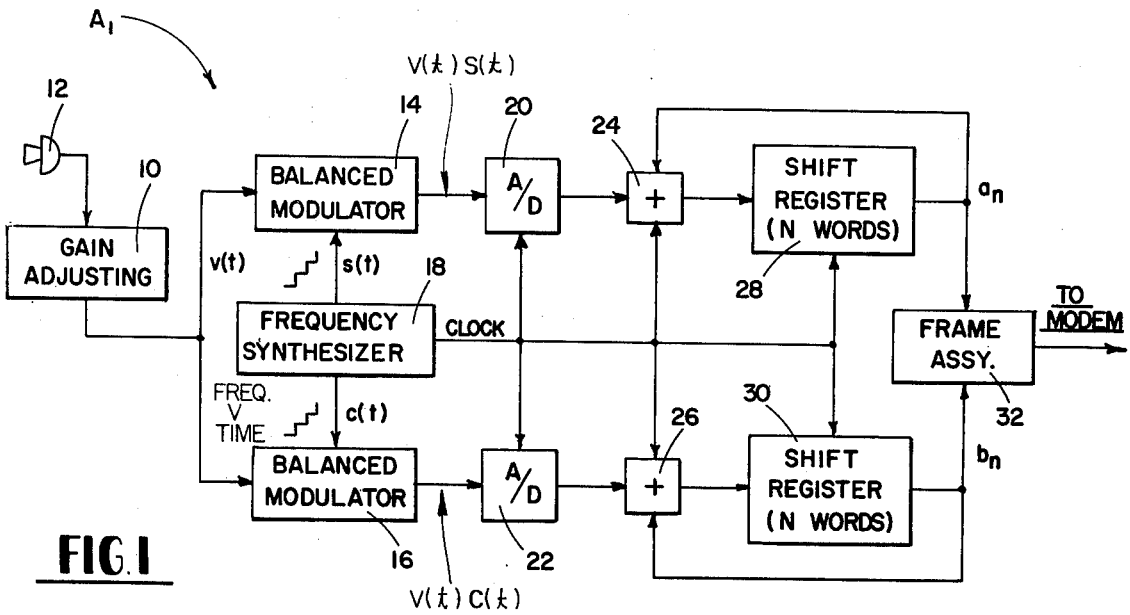
FIG. 1
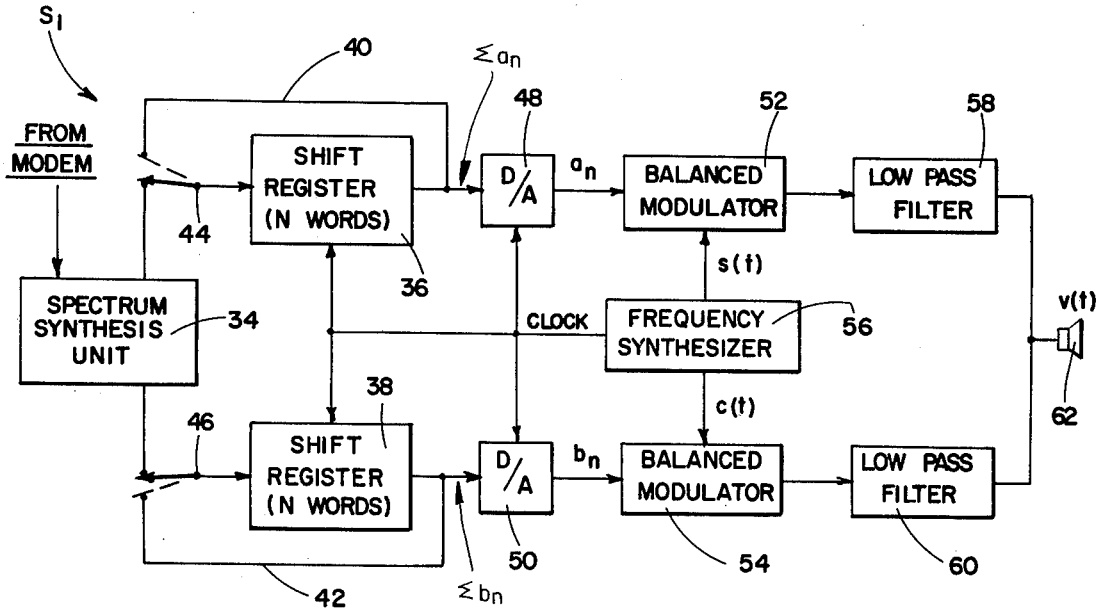
FIG. 2
| BASE BAND | UPPER BAND | SYNC. CODE |
|---|---|---|
| SLOTS 1 – 180 | SLOTS 181 – 246 | SLOTS 247–256 |
FIG. 7

VOCODER SYSTEMS PROVIDING WAVE FORM ANALYSIS AND SYNTHESIS USING FOURIER TRANSFORM REPRESENTATIVE SIGNALS

RELATED APPLICATION

This application is a continuation-in-part of application Ser. No. 491,928 filed July 25, 1974, now abandoned.

BACKGROUND OF THE INVENTION

This invention relates in general to certain new and useful improvements in vocoder systems and, more particularly, to vocoder systems which provide wave form analysis and synthesis using Fourier transform representative signals.

In recent years, vocoder systems which are used for voice transmission and reception have received widespread attention. One of the more successful approaches to speech band width compression resides in the channel vocoder as described in U.S. Pat. No. 2,151,091 for Signal Transmission. This channel vocoder has evolved into an instrument of excellent intelligibility and good reliability. However, vocoders of this type have not found an extensive application due to the very substantial size of these instruments and the cost of purchase and maintenance.

One of the important criteria of an effective vocoder is that it must be capable of reproducing natural-sounding speech and retaining the voice individuality of the original speaker.

The present-day voice-excited vocoder generally uses one band pass filter (baseband filter) covering an approximate 250–930 Hz region for selecting a portion of the input voice signal to be transmitted with high fidelity together with several other band pass filters covering a frequency range of approximately 930 to 3230 Hz region in approximate 230 Hz increments, which are to be transmitted with lesser fidelity. The output of the baseband filter is immediately digitized while the outputs of all the other band pass filters are first rectified, smoothed, and then digitized. Thereafter, all of the channels are multiplexed for transmission.

At the receiving end, these channels are demultiplexed and converted back to analog form. The base band signal is then rectified and differentiated by an excitation generator and then passed through a bank of band pass filters and limiters to form a spectrally flattened excitation function. These excitation signals are modulated by the low frequency signals derived from the spectrum analysis process performed in the vocoder analyzer. The outputs from the modulators are then filtered to remove the nonlinear distortion introduced by the limiters and the resulting signals are combined with the base band signal to form the synthesized speech signal. This system, while it is effective, is nevertheless generally based upon analysis and synthesis of signals in analog format. There have been several attempts to use an all-digital approach to analysis and synthesis based on increased development of integrated circuit technology. However, these attempts to utilize a digital type system have not been particularly efficient from the standpoint of the utilization of large-scale integrated circuits.

The present invention provides a vocoder which permits a wave form analysis and synthesis technique based on Fourier transform representations of signals. In one embodiment of the present invention, a purely digital system approach is used. In another embodiment of the present invention, a hybrid approach using both analog and digital techniques is employed, and which has at least the same flexibility as the pure digital approach. In addition, the vocoder systems of the present invention are capable of handling wider band width signals and are less complex than the various vocoder systems heretofore designed.

It is therefore the primary object of the present invention to provide a vocoder system including a vocoder analyzer and vocoder synthesizer which is capable of reproducing natural-sounding speech and which retains the voice individuality of the original speech.

It is another object of the present invention to provide a system for wave form analysis and synthesis using Fourier transform representative signals.

It is a further object of the present invention to provide a vocoder system of the type stated which is capable of analyzing and synthesizing signals having a broad frequency spectrum.

It is another salient object of the present invention to provide a method of analyzing and synthesizing wave forms which is relatively economical and requires a minimum of operations.

It is an additional object of the present invention to provide a vocoder system of the type stated which is highly reliable and can be manufactured at a relatively low unit cost and which is nevertheless compact in size.

With the above and other objects in view, my invention reside in the novel features of form, construction, arrangement, and combination of parts presently described and pointed out in the claims

BRIEF DESCRIPTION OF THE DRAWINGS

Figure 3:
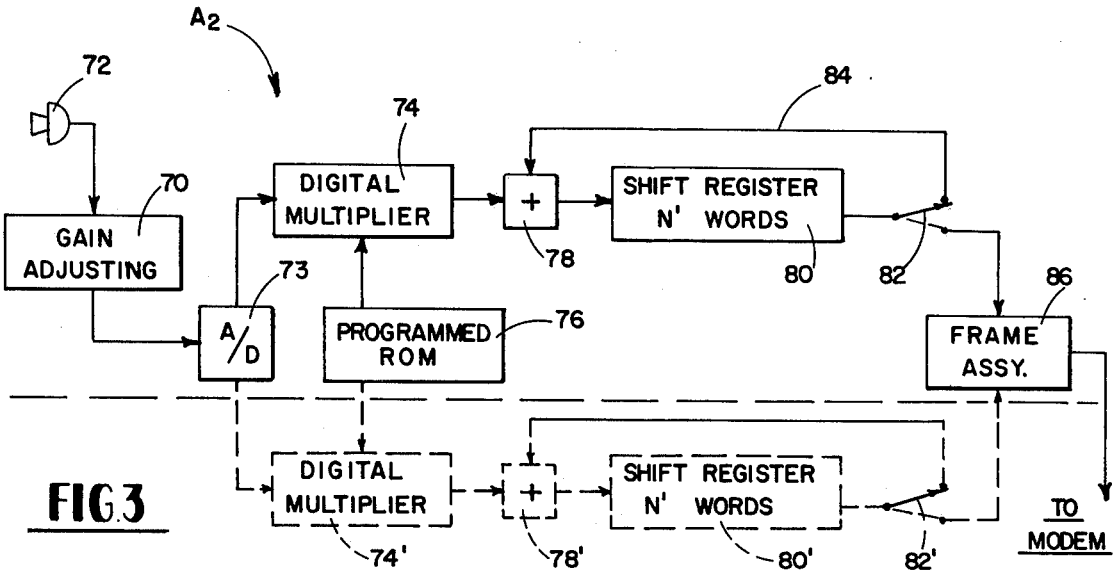
Figure 6:
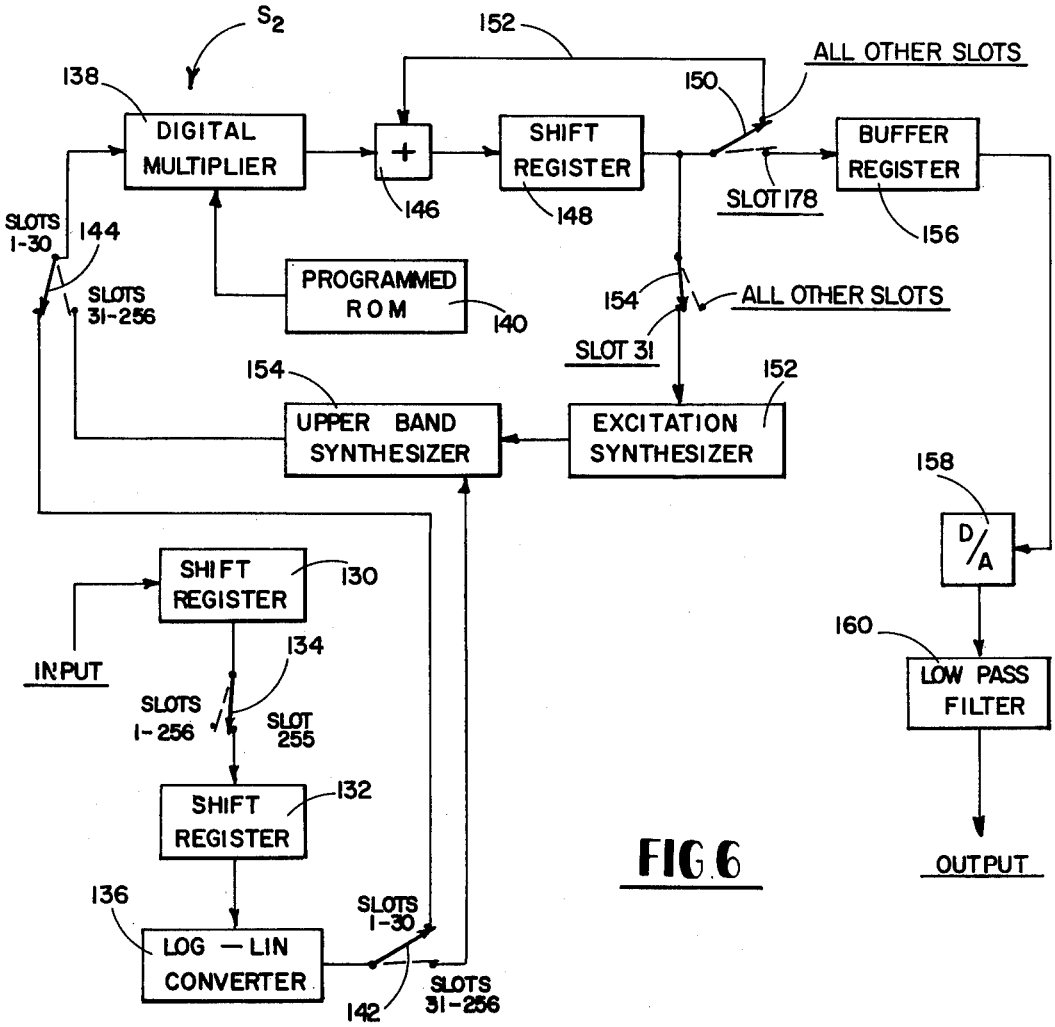
Figure 4:
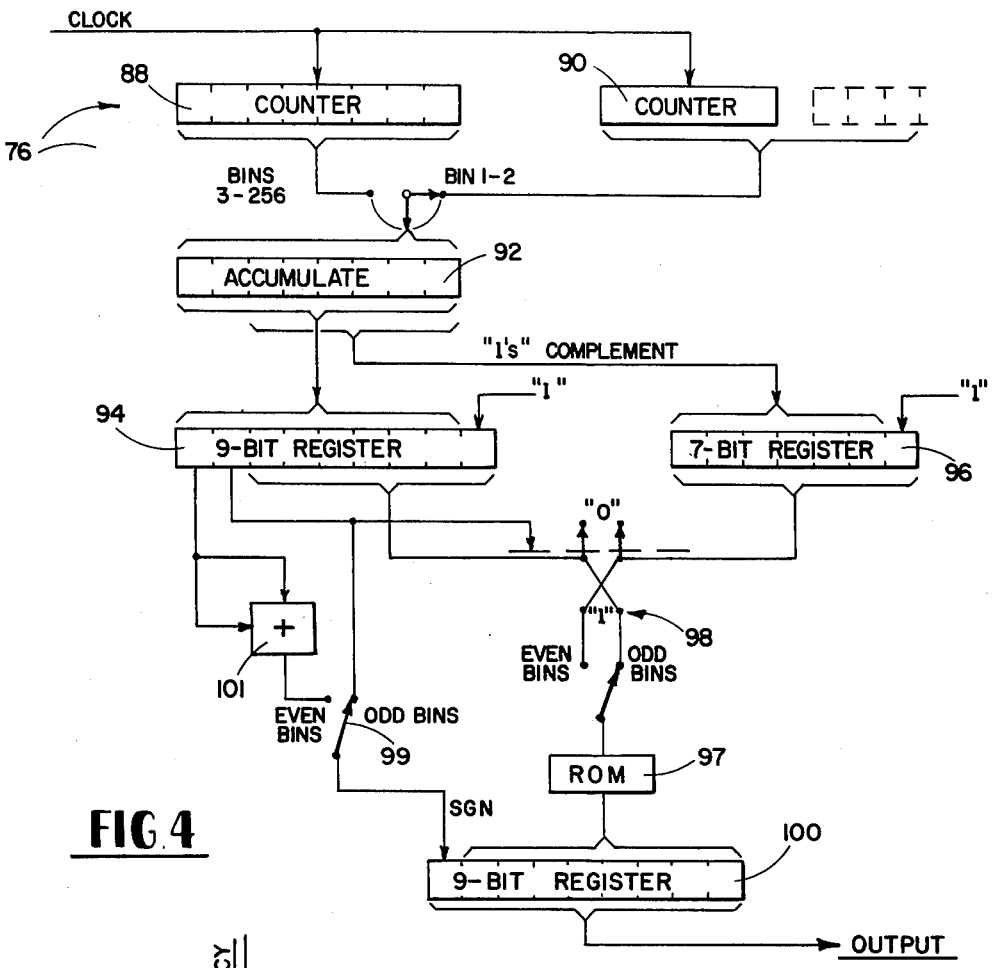
Figure 8:
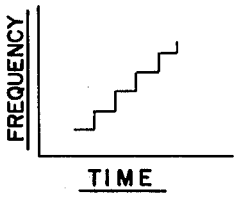
Figure 5:
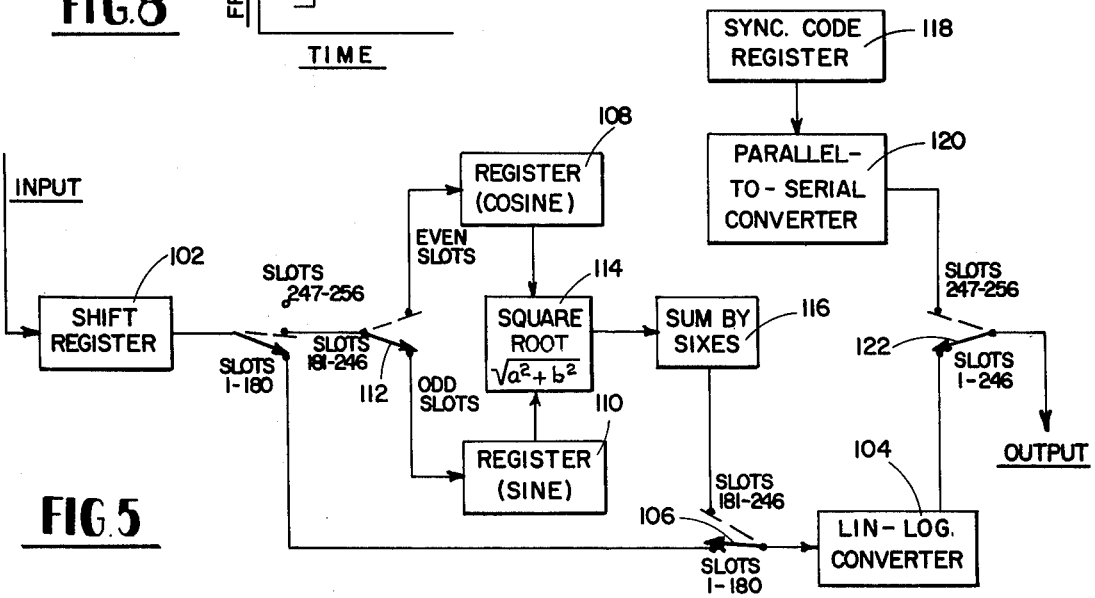
Figure 9:
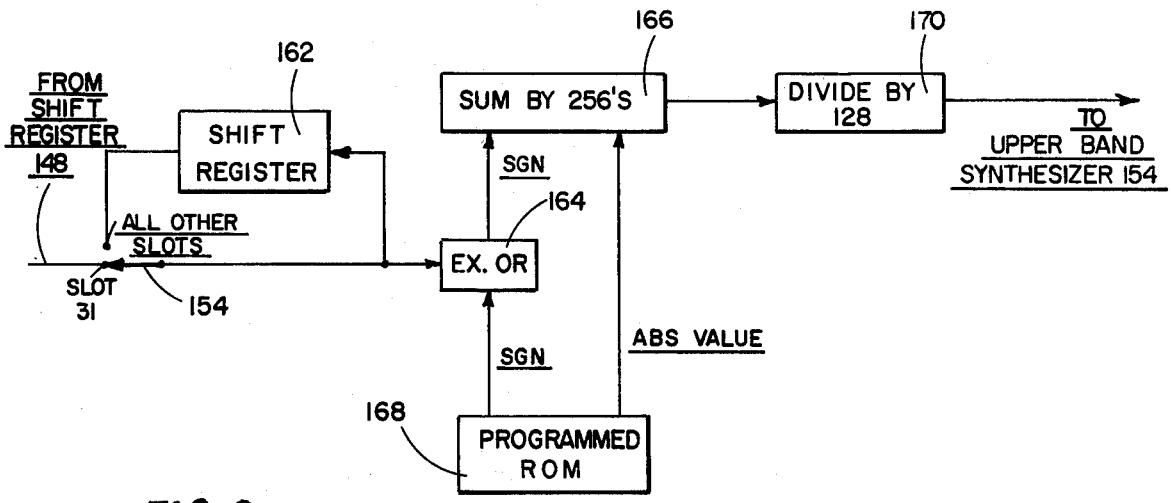
Figure 10:
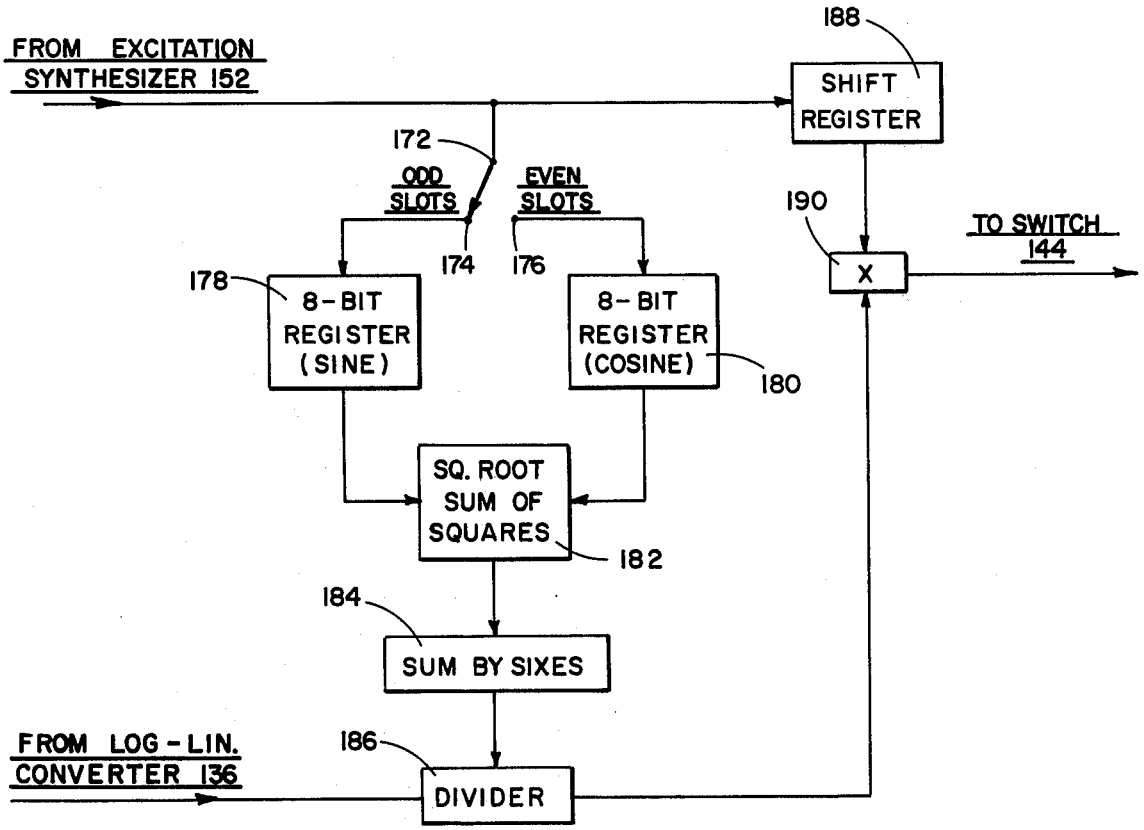
Figure 11:
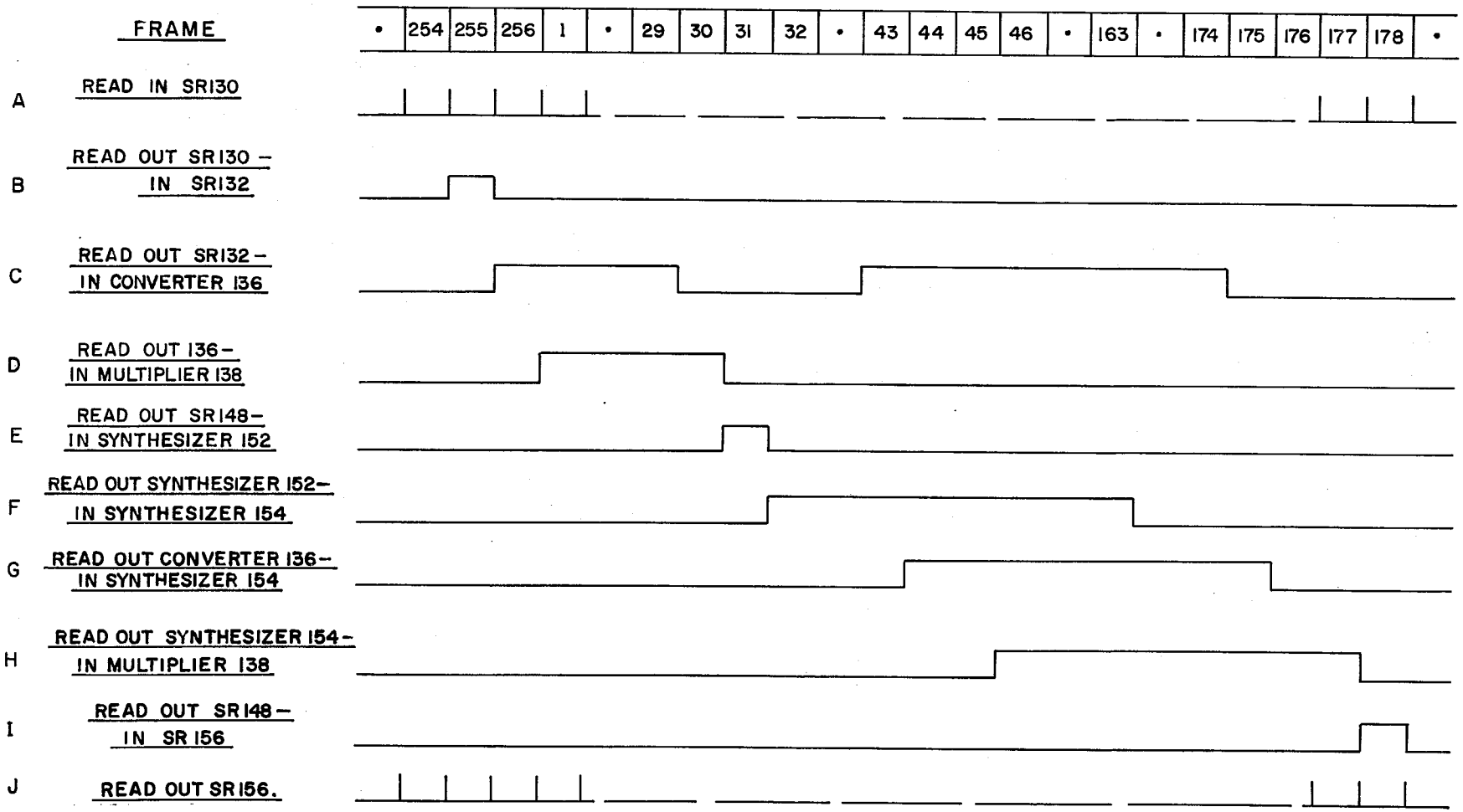

Having thus described the invention in general terms, reference will now be made to the accompanying drawings in which:

FIG. 1 is a schematic block diagram of a vocoder analyzer constructed in accordance with and embodying the present invention;

FIG. 2 is a schematic block diagram illustrating a vocoder synthesizer constructed in accordance with and embodying the present invention;

FIG. 3 is a schematic block diagram of a modified form of vocoder analyzer constructed in accordance with and embodying the present invention;

FIG. 4 is a schematic block diagram of a read only memory which forms part of the analyzer of FIG. 3;

FIG. 5 is a schematic block diagram of a frame assembly unit which forms part of the vocoder analyzer of the present invention;

FIG. 6 is a schematic block diagram of a modified form of vocoder synthesizer constructed in accordance with and embodying the present invention;

FIG. 7 is a schematic view showing slots allocated to the baseband, upperband and sync code in accordance with one arrangement of the present invention;

FIG. 8 is a diagram showing a signal form from the frequency synthesizer to balanced modulators in FIG. 1;

FIG. 9 is a schematic block diagram of an excitation synthesizer forming part of the vocoder synthesizer of FIG. 6;

FIG. 10 is a schematic block diagram of an upperband synthesizer forming part of the vocoder synthesizer of FIG. 6; and FIG. 11 is a schematic diagram showing signal forms demonstrating the timing in the synthesizer of FIG. 6.

DETAILED DESCRIPTION

A. Analog-Digital Vocoder Analyzer

Referring now in more detail and by reference characters to the drawings, $A_1$ designates a vocoder analyzer illustrated in FIG. 1 which operates on a hybrid analog-digital technique. The vocoder analyzer $A_1$ generally comprises a voice gain adjusting device 10 which may receive an input analog signal, such as a voice signal from a microphone output 12. The voice signal, which may be represented by $v(t)$, is presented at the output of the voice gain adjusting device (often referred to as a "vogad"). This vogad maintains nearly-constant signal levels at the inputs to a pair of balanced modulators 14 and 16.

The balanced modulators receive a sine wave signal designated as $S(t)$ and a cosine wave signal designated as $C(t)$, respectively, from a frequency synthesizer 18. The voice signal $v(t)$ is mixed with the two signals $S(t)$ and $C(t)$ developed in the frequency synthesizer 18. The sine and cosine wave signals $S(t)$ and $C(t)$ have frequencies which increase by 1/T Hz over periodic time intervals (every T seconds). In this case, the frequency increase of these signals will start over at the end of each frame (to be hereinafter described), or in steps, as for example, 128 steps.

The balanced modulators 14 and 16 serve to multiply the input signals for introduction into a pair of analog-digital converters 20 and 22 respectively. Thus, the signal introduced into the analog-digital converter 20 may be represented by $v(t)\ S(t)$ and the signal introduced into the analog-digital converter 22 may be represented by $v(t)\ C(t)$. The output of the modulators 14 and 16 is actually the "Multiplier Output" in the following Table II, as hereinafter described in more detail. In essence the $a_n$ and $b_n$ components are designated as "$x$" in Table II.

The outputs of the balanced modulators 14 and 16 are sampled and digitized at periodic time intervals to generate N samples. The output of the analog-digital converter 20 is introduced into an adder 24, which may be a summing node, and the output of the analog-digital converter 22 is introduced into an adder 26, which may also be a summing node. The output of the summing node 24 is introduced into a shift register 28 sized to contain N words. In like manner, the output of the summing node 26 is introduced into a shift register 30, which is also sized to contain N words. The outputs of each of the shift registers 28 and 30 are introduced into a frame assembly 32, which is hereinafter described in more detail. In like manner, the outputs of these shift registers 28 and 30 are also recirculated to the summing nodes 24 and 26, respectively, in the manner as illustrated in FIG. 1 of the drawings. In this way, the adders 24 and 26 in combination with the shift registers 28 and 30 selectively sum groups of N samples.

The voice gain adjusting device 10 may generally be constructed with a pair of operational amplifiers which are commercially available in the form of micro-circuit chips. Each of the analog-digital converters 20 and 22 generally require one operational amplifier along with several analog comparators. The adders 24 and 26 are preferably eight-bit adders, and each of which may be constructed from eight single-bit full adders plus a pair of dual quad latches. While only one shift register 28 and one shift register 30 are illustrated in the drawings, it should be understood that in order to increase register word lengths, two or more registers for each of the sine and cosine signals could be utilized.

By further reference to FIG. 1 of the drawings, it can be observed that the frequency synthesizer 18 also generates clock output signals designated as $S(t)$ and $D(t)$. These clock signals are introduced into the analog-digital converters 20 and 22 and the adders 24 and 26, as well as the shift registers 28 and 30.

The outputs of the adders 24 and 26 are introduced into a frame assembly 32 and the major function of the frame assembly 32 is to perform operations of multiplication, addition, and squarerooting. These functions can be implemented with several shift registers including J-K flip-flops and certain quad input NAND gates included in the frame assembly 32. The actual design of the frame assembly would be obvious to the skilled artisan given the described input, output relationships. In essence, the frame assembly 32 will thus be similar to the frame assembly illustrated in FIG. 5 and as described herein.

An "analysis frame" generally contains $N^2$ samples which are gathered over a time period of NT. At the beginning of the analysis frame, it may be assumed that each of the shift registers 28 and 30 are filled with zeros. These zeros are added to the first N samples of the analysis frame and the results are shifted into the respective shift registers. The first N samples are then circulated through the adders 24 and 26 and combined with the next N samples in the following manner. The first sample is added to the (N+1) sample, the second sample is added to the (N+2) sample, and so forth until the (N)th sample is added to the (2N)th sample.

The contents of the shift registers are circulated N times so that at the end of the analysis frame, the upper and lower shift registers respectively contain the sums $a_n$ and $b_n$. Thus, the $a_n$ samples and the $b_n$ samples can be designated by the following expressions which are the digital representations of the Fourier transform of $v(t)$, namely:

$$a_n = \sum_{m=1}^{N} v\left[\frac{nT}{N} + (m-1)\,T\right] \sin 2\pi \frac{nm}{N}$$

$$b_n = \sum_{m=1}^{N} v\left[\frac{nT}{N} + (m-1)\,T\right] \cos 2\pi \frac{nm}{N}$$

The implementation of the above equations would result in the calculation of the Fourier components of the input signals at certain frequency intervals, as for example, 40 Hz. This could extend over a range of 8,000 Hz, as for example, from −4,000 Hz to +4,000 Hz. The negative frequency spectrum is identical to the positive frequency spectrum and, hence, it is not necessary to compute all such components.

The final step in the vocoder analysis process is accomplished in the frame assembly unit 32. The square root of the sum of the squares of the sine and cosine components of the signal extending, as for example, from 800 Hz to 3,200 Hz are grouped into ten channels and multiplexed with the base band components of the signals extending from 200 Hz to about 800 Hz for transmission.

In essence, the frame assembly unit 32, which is used in the vocoder analyzer $A_1$, can adopt a similar form of construction to that frame assembly illustrated in FIG. 5. While the frame assembly illustrated in FIG. 5 is actually adapted for use in the vocoder analyzer $A_2$, as illustrated in FIG. 3, it is nevertheless applicable for use in the frame assembly 32.

The following table designated as Table I more fully sets forth the output of the frame assembly unit 32, and shows the characterization of each frame in terms of the 256 bits for each frame and the data, along with frequency and bandwidth. In this case, the center frequency and the bandwidth are designated in hertz. The term "ENV", as indicated in Table I, represents an envelope. In essence, this output frame is the representation of the input to the synthesizers.

TABLE I

| | FRAME | | | | | | | | | | | | |
|---|---|---|---|---|---|---|---|---|---|---|---|---|---|
| Bits | 1–6 | 7–12 | 13–18 | 19–24 | ... | 169–174 | 175–180 | 181–186 | 187–192 | ... | 241–246 | 247–253 | 254–256 |
| Data | Baseband | | | | | | | Upper Band | | | | Sync | Not |
| Category Type of Data | Sin | Cos | Sin | Cos | ... | Sin | Cos | Env | Env | ... | Env | Barker Code | |
| Number of Bits | 6 | 6 | 6 | 6 | ... | 6 | 6 | 6 | 6 | ... | 6 | 7 | Used |
| Center Frequency | 300 | | 337.5 | | ... | 825 | | 956.25 | 1181.25 | ... | 3206.25 | — | |
| Bandwidth | 37.5 | | 37.5 | | ... | 37.5 | | 225 | 225 | ... | 225 | — | |

The first 30 words of information stored in the shift registers 28 and 30 describe the base band spectrum. In this case, the data is read out at a rate of one word for every six slots over a period of 180 slots. This data is converted from a linear to a logarithmic scale and from parallel to serial bit organization by a lin-log converter, such as the converter 104 illustrated in FIG. 5. At the end of the 180th slot, upper band data begins to feed out of the 256 word shift registers, and this data is fed alternately into 8-bit registers, essentially corresponding to the registers 108 and 110 in FIG. 5 of the drawings. At the end of every even slot, the square root of the sum of the squares of the contents of the two registers is extracted. The square root data corresponds to the high resolution upper band envelope data, and this data is summed in groups of six and the resulting sums are converted from a linear to a logarithmic scale by means of the aforesaid lin-log converter. There are no sign bits associated with the upper band data, particularly when the lin-log converter is being used for upper band data during slots 181–246. At the end of the 246th slot, all upper band data has been processed by the frame assembly unit and the sync code contained in a register, such as the register 120, is read out serially during slots 247 through 256.

In essence, all of the analysis is performed by the analyzer in FIG. 1 and is presented at the output of the frame assembly unit 32. The whole frequency spectrum of the voice band is examined and processed completely within the vocoder analyzer $A_1$, as illustrated in FIG. 1. The same holds with respect to the examination and processing of the spectrum of the voice band in the vocoder analyzer $A_2$, illustrated in FIG. 3 of the drawings.

B. Analog-Digital Vocoder Synthesizer

FIG. 2 illustrates a vocoder synthesizer $S_1$ which also operates on the hybrid analog-digital technique. The vocoder synthesizer $S_1$ receives the output from the frame assembly which may be transmitted over conventional modems or the like, and this input sample to the synthesizer $S_1$ is introduced into a spectrum synthesis unit 34. The necessary sync code recognition circuitry is provided in the spectrum synthesis unit 34 which establishes frame and slot timing for the synthesizer $S_1$. The formation introduced into the synthesis unit 34 exists in the form of a digital code, and the synthesis unit will recreate the Fourier component values $a_n$ and $b_n$. This recreation of the Fourier component values is accomplished by performing a double convolution of the base band spectrum of the original signal, as for example, the 200 Hz - 800 Hz base band spectrum. In essence, the synthesis unit 34 performs a function which is the reverse of that performed at the output of the frame assembly 32. The output of the frame assembly 32 is a flattened spectrum which has been compressed to achieve minimum space. The synthesis unit will merely expand the reduced output from the frame assembly 32, and thereby regenerates the Fourier component values $a_n$ and $b_n$. In this way, it is possible to obtain an excitation spectrum extending from 800 Hz to 3,200 Hz.

The spectrum obtained in this way is first "flattened" and then adjusted in amplitude in accordance with the received information relating to the voice spectrum in the 800 Hz to 3,000 Hz range. It can be observed that in accordance with the alogrithm, upon which the system of the present invention is predicated, a spectrum flattening occurs with the a cosine component and the $b$ sine component. Thus, the value of $a$ divided by the square root of the sum of the squares of $a$ and $b$ and the value of $b$ divided by the square root of the sum of the squares of $a$ and $b$ will result in flattened spectrum of uniform amplitude. In this way, by dividing the effective sine and cosine amplitudes by the sum of the square root of the squares in a relatively simple computation, the spectrum is made of uniform amplitude. The newly derived spectral components for this range, together with the spectral components for the 200 Hz to 800 Hz range, provide a complete set of $a_n$ Fourier component values, and a complete set of $b_n$ Fourier component values. Thus, a flattened spectrum is one where the square root of the sum of the squares of $a$ and $b$ is constant across the band.

These $a_n$ component values are introduced into a shift register 36 sized to contain N words, and the $b_n$ Fourier component values are introduced into a shift register 38 also sized to contain N words. The shift registers 36 and 38 may also be provided with recirculating feed-backs 40 and 42 which are optionally connected in feed-back relationship through switches 44 and 46, respectively. In addition, the outputs of the shift registers 36 and 38 are introduced into digital-analog converters 48 and 50, respectively, where the outputs of these shift registers 36 and 38 are converted into analog values, again providing complete sets of representation of the sums $a_n$ and $b_n$. The $a_n$ and $b_n$ sums are introduced into the separate shift registers 36 and 38 and recirculated once every T seconds.

FIG. 2 illustrates the outputs of the shift registers 36 and 38, respectively, as $a_n$ and $b_n$ where the true outputs are representations of the sums of $a_n$ and $b_n$.

The outputs of the analog-digital converters 48 and 50 are respectively introduced into balanced modulators 52 and 54. The frequency synthesizer 56 provides an S(*t*) sine wave signal to the balanced modulator 52 and the C(*t*) cosine wave signal C(*t*) to the balanced modulator 54. In like manner, the frequencies of these signals increase by 1/T Hz every T seconds, which may occur in stages as previously described.

The frequency synthesizer 56 is synchronized with the outputs of the analog-digital converters 48 and 50 so that the analog values of $a_n$ and $b_n$ enter the balanced modulators at pre-established periodic time intervals. The frequency synthesizer also generates clock signals which are introduced into the two analog-digital converters 48 and 50, and the two shift registers 36 and 38.

The sampled analog signals are converted into continuous signals by means of low pass filters 58 and 60 respectively. The low pass filters process all values of *n* for each of the signals simultaneously so that the low pass filters generate signals which can be designated as:

$$\sum_{n=1}^{N} a_n \sin 2\pi \frac{n}{NT} t$$

$$\sum_{n=1}^{N} b_n \cos 2\pi \frac{n}{NT} t.$$

These two expressions for the two signals are summed at the output of the low pass filter to produce the synthesized voice signal, which may be reproduced using a conventional speaker device 62.

The spectrum synthesis unit 34 is generally designed to perform low speed additions and multiplications, and any of a number of conventional systems may be utilized therefor. In addition, the spectrum synthesis unit 34 will contain a buffer storage member. For this purpose, a small number of shift registers, as for example, 8-bit shift registers, several J-K flip-flops and several NAND gates are required. With respect to the frequency synthesizer 56 in the vocoder synthesizer $S_1$, and the frequency synthesizer 18 in the vocoder analyzer $A_1$, it is also possible to use a single frequency synthesizer which may be shared between the analyzer $A_1$ and the synthesizer $S_1$.

In actuality, FIG. 2 is more of a conceptual illustration of exactly how the synthesis is performed. The synthesizer would actually be constructed in the form as illustrated in FIG. 6 which in essence would perform the synthesis operation as schematically illustrated in FIG. 2. The construction of the synthesis unit, as illustrated in FIG. 6, is a far more efficient form of performing the synthesis operation. The spectrum synthesis unit 34 in FIG. 2 actually comprises the synthesizer illustrated in FIG. 6, except that it would not include the buffer register 156, the digital-to-analog converter 158 and the low pass filter 160. However, the other components, as illustrated in FIG. 6, would essentially constitute the spectrum synthesis unit 34.

In essence, the synthesizer $S_1$, as well as the synthesizer $S_2$ as hereinafter described, performs the spectral synthesis, and at the same time performs the Fourier transform on the synthesized spectrum. Again, the actual synthesis operation is more fully described in connection with FIG. 6 of the drawings.

C. Digital Vocoder Analyzer

FIG. 3 of the drawings illustrates a modified form of vocoder analyzer $A_2$ which operates on the principle of using purely digital techniques in order to analyze a signal. The analyzer $A_2$ generally comprises a voice gain adjusting device, such as a vogad 70, which receives the external signal from a microphone 72 or similar input device.

The output of the gain adjusting device 70 is introduced into a digitizing circuit, such as an analog-to-digital converter 73 which converts the signal to a digital format. The output of the analog-to-digital converter 73 is introduced into a digital multiplier 74, which receives sine and cosine values supplied by a programmed read-only-memory 76. In this case, the analysis of the input signal may be performed in time related computational frames. Each computational frame may be divided into a number of slots as, for example, 256 slots, and each slot may be further divided into a number of bins as, for example, 256 bins.

The number of bits in an instantaneous sample is only a design selection and may be arbitrary, e.g. 8 to 10 bits. Thus any word configuration could be employed such that any number of bits could constitute a byte and any one or more bytes could be employed in any word. The number of words existing in one frame has been established as 256 in accordance with the present invention, although this is only a design criterion which could be modified. In this same respect, it should be observed that the word sizes change with respect to the processing of the present invention. For example, a seven-bit word is used in some respects with respect to a seven-bit shift register; a nine-bit word is used in other places, with respect to a nine-bit register.

The input data which may be designated as $x_n$ is associated with each of the slots in a particular manner so that during the *n*th slot, the particular data point $x_n$ is multiplied by the sine and cosine values which are supplied by the read-only-memory 76. One multiplication will take place during each bin with the sine multiplications occurring during the odd numbered bins and the cosine multiplications occurring during the even number bins.

The output products from the digital multiplier 74 are introduced into an adder 78, where these products are added to recirculating contents of a shift register 80 sized to contain N′ words. In this respect, it can be observed that the output of the shift register 80 is connected through a two-position switch 82 to a recirculating feedback line 84, the output end of which is connected to the adder 78.

The delay created by the shift register 80 in recirculating the data to the adder 78 is equivalent to one slot period and, therefore, as the data for the second slot period arrives at one input to the adder, the data for the first slot period arrives over the recirculating feedback line 84 at the other input thereof. The data for these two slots are added together on a bit-by-bit basis and the results are thereupon introduced into the shift register 80. During the third slot period, the third slot data is added to the sum of the first slot and second slot data at the adder 78, and so forth. At the end of any particular frame, the data for all of the slots in this frame have then been summed, and these sums are equivalent to the Fourier transform coefficient.

At the end of any particular frame, the switch 82 at the output of the shift register 80 is shifted to the position illustrated in the dotted lines of FIG. 3 for introduction into a frame assembly 86. As the first slot data for the next frame is introduced into the shift register 80, the Fourier transform coefficient data is transferred from the shift register 80 into the frame assembly unit 86.

It can be observed that a two-stage analyzer could be provided in accordance with the present invention by additionally utilizing the circuitry illustrated in the dotted lines of FIG. 3. In this case, a second digital multiplier 74' would be provided for also receiving the data from the analog-to-digital converter 73. In this case, the digital multiplier 74 would receive sine values supplied by the read-only-memory 76 and the digital multiplier 74' would receive cosine values supplied by the read-only-memory 76. The output of the digital multiplier 74 would be introduced into an adder 78' which, in turn, operates in conjunction with a shift register 80' sized to contain N' words. In like manner, the shift register 80 would be provided with a two-position switch 82' and a recirculating feedback line 84'. Furthermore, the output of the switch 82 would also be connected to the modem. In this respect, the vocoder analyzer $A_2$ would operate in a manner similar to the vocoder $A_1$, except that the analyzer $A_2$ would operate with a pure digital computational procedure.

The Fourier transform unit which forms part of the analyzer $A_2$ actually includes the programmed read-only-memory 76, the digital multiplier 74 and the combination of the adder 78 and the shift register 80. In the alternate configuration, the Fourier transform unit would include the additional multiplier 74', the adder 78' and the shift register 80'. The actual operation of the Fourier transform unit, and in essence the analyzer $A_2$, can be most conveniently recognized in terms of the framing information contained in the following Table II.

The Fourier transform unit computational frame, as illustrated in Table II, is divided into 256 slots, and each slot is divided into 236 bins. The input data which is designated as $x$ is associated with the various slots as shown in the upper portion of Table II. The center portion and the lower portion of Table II designate a particular slot $n$ and the analog-digital data sample $x_n$ associated therewith. In this case, during the $n$th slot, the particular data point $x_n$ is multiplied by sine and cosine values which are supplied by the programmed read-only-memory 76. One multiplication takes place during each bin with the sine multiplications occurring during the odd numbered bins and the cosine multiplications occurring during the even numbered bins. In this case, any particular data sample $x_n$ is equal to $$x_n = x(t=n/9600),$$

where $t$ is the time value.

In the multiplication operations, and considering the center portion of Table II, $s$ designates a sine value and $c$ designates a cosine value, where $$s_{n,m} = \sin 2\pi \frac{nm}{256}\ ;\ c_{n,m} = \cos 2\pi \frac{nm}{256}\ .$$

The products which are fed out from the multiplier 74 and into the adder 78 are added to the recirculating contents of the shift register 80. At the beginning of the frame, the shift register contains all zeros, and consequently, nothing is added to the multiplier outputs during the first slot as they pass into the shift register. The shift register delay is equivalent to one slot period and, therefore, as the data for the second slot arrives at one input of the adder 78, the data for the first slot arrives at the other input. The data for the two slots are added together on a bin-by-bin basis and the results are introduced into the shift register 80. During the third slot, the third slot data are added to the summed first and second slot data.

At the end of the frame, the data for all of the slots have been summed. The contents of the shift register at this particular instant are shown in the lower portion of Table II. The sums can be recognized as the Fourier coefficients which are defined by the following equations:

$$a_m = \sum_{n=1}^{N} x_n \sin 2\pi \frac{nm}{N}$$

$$b_m = \sum_{n=1}^{N} x_n \cos 2\pi \frac{nm}{N}\ .$$

The analysis frequency is the center frequency and the noise equivalent bandwidth for each of the bins is also illustrated in the lower portion of Table II and these numbers are present in terms of hertz.

At the end of the frame, the switch 82 connects the shift register 80 to the output line and as the first data for the next frame feeds into the shift register 80, the Fourier coefficient data feeds out of the shift register and into the frame assembly unit 86.

TABLE II

| | | | | | | | | | | | |
|---|---|---|---|---|---|---|---|---|---|---|---|
| | Frame | | | | | | | | | | |
| Slot | 1 | 2 | 3 | | ..... | | n | ..... | | 255 | 256 |
| A/D Sample | $x_1$ | $x_2$ | $x_3$ | | | | $x_n$ | | | $x_{255}$ | $x_{256}$ |
| Slot | n | | | | | | | | | | |
| Bin | 1 | 2 | 3 | 4 | 5 | 6 | ..... | 161 | 162 | ... | 256 |
| Sin/Cos Values | $s_{n,8}$ | $c_{n,8}$ | $s_{n,9}$ | $c_{n,9}$ | $s_{n,10}$ | $c_{n,10}$ | ..... | $s_{n,88}$ | $c_{n,88}$ | NOT USED | |
| Multiplier Output | $x_n s_{n,8}$ | $x_n c_{n,8}$ | $x_n s_{n,9}$ | $x_n c_{n,9}$ | $x_n s_{n,10}$ | $x_n c_{n,10}$ | ..... | $x_n s_{n,88}$ | $x_n c_{n,88}$ | | |
| Slot | 256 | | | | | | | | | | |
| Bin | 1 | 2 | 3 | 4 | 5 | 6 | ..... | 161 | 162 | ... | 256 |
| Shift Register Contents | $\sum_n x_n s_{n,8}$ | $\sum_n x_n c_{n,8}$ | $\sum_n x_n s_{n,9}$ | $\sum_n x_n c_{n,9}$ | $\sum_n x_n s_{n,10}$ | $\sum_n x_n c_{n,10}$ | ..... | $\sum_n x_n s_{n,88}$ | $\sum x_n c_{n,88}$ | | |
| Data | Sin | Cos | Sin | Cos | Sin | Cos | | Sin | Cos | NOT USED | |
| Center Freq. | 300 | | 337.5 | | 375 | | | 3300 | | | |
| Bandwidth | 37.5 | | 37.5 | | 37.5 | | | 37.5 | | | |

FIG. 4 illustrates in block diagram form, the arrangement of the programmed read-only-memory 76. In this case, it can be observed that the memory 76 includes an eight-bit counter 88 and a five-bit counter 90. As indicated previously, the read-only-memory 76 provides the sine and cosine values for the multiplication process and the sine and cosine selection process is controlled by the two counters 88 and 90.

At the beginning of any computational frame, the eight-bit counter 88 and the five-bit counter 90, along with an eight-bit accumulator 92, are empty. A pulse is introduced into each of the counters 88 and 90 at the beginning of each slot period, and in this way, the eight-bit counter 88 will keep track of the time during a particular frame in terms of a slot number. The slot number is also registered in the five-bit counter 90. The contents of the five-bit counter 90 are first introduced into the accumulator 92, and subsequently, the contents of the eight-bit counter 88 are introduced into the accumulator 92, and are summed in this accumulator 92 at half of the bin rate.

In order to more fully illustrate the selection of sine and cosine values, it may be assumed, for example, that the 51st bin of the 178th slot has been reached. At this point, the contents of the eight-bit counter 88 is 10110010 (178). In like manner, the contents of the five-bit counter is 10010 (18). The first entry into the accumulator 92 during the 178th slot was the number 18 from the counter 90, and this was multiplied by a factor of eight, as a result of being entered into the five most significant bit positions of the accumulator 92. At the time of the 51st bin, the contents of the eight-bit register 88 have been entered into the accumulator 25 times making a contribution of $25 \times 178$. Consequently, the total registered by the accumulator 92 is then 242 and in binary notation is 11110010.

This number in the accumulator 92 is then introduced into the eight most significant bit positions of a nine-bit register 94, and a binary one is inserted in the least significant bit position of this register 94. The ones compliment of the number entered into the six least significant bit positions of the accumulator 92 is introduced into the six most significant bit positions of a seven-bit register 96. Consequently, at this time, the contents of the nine-bit register 94 is 111100101 (485) and the contents of the seven-bit register 96 is 0011011 (27). Inasmuch as the second most significant bit in the nine-bit register 94 is one, the switch 98 is shifted to the lower position. Furthermore, the number which has been stored in the seven-bit register 96 is used to address a read-only memory or so-called "ROM" 97. The contents of the registers 94 and 96 are introduced into the ROM 97 through a two-position switch 98 as illustrated in FIG. 4 of the drawings so that the data from even numbered and odd numbered lines may be alternately introduced into the ROM 97.

The read-only memory produces the sine of the angle obtained by dividing the address by 512 and multiplying by $2\pi$. In this case, since the address in 27, the read-only memory produces the sine of $2\pi(27/512)$ which is introduced into the eight least significant bit positions of a second nine-bit register 100. A sign bit is introduced into the most significant bit position of the nine-bit register 100 through a switch 99 which operates in conjunction with a modulo 2 summer 101 in the manner as illustrated in FIG. 4 of the drawings.

Considering the 52nd bin of the same slot, the conditions in the programmed read-only memory 97 are the same as described above, except that the ROM 97 is addressed by the seven least significant bits of the nine-bit registers 94, since the 52nd bin is an even-numbered bin. The address, in decimal notation, is 101. The read only memory 98 will then produce the number sine $2\pi(101/512)$ which is also inserted in the nine-bit register 100.

The frame assembly unit 86 is more fully illustrated in FIG. 5 of the drawings and includes a 256 word shift register 102 which received the output of the shift register 80 during the first slot of each frame. The first thirty words which are stored in the shift register 102 describe the base band spectrum. This information is introduced into the shift register 80 and is processed and then transferred to the frame assembly 86. The spectrum is actually calculated from the incoming signal data which is introduced into the shift register 80 and the register 80 in combination with the adder 84 generate the bandpass spectrum which is introduced into the frame assembly 86. The data is read out from the shift register 102 at a rate of one word for every six slots over a period of 180 slots. This data is then converted from a linear to a logarithmic scale, and from a parallel to a serial bit organization by a lin-log converter 104, to be hereinafter described in more detail.

It can be observed that the output of the shift register 102 is connected through a two position switch 106 where the lower position (as illustrated in solid lines in FIG. 5) carries the first 180 slots to the lin-log converter 104. The upper position of the switch (illustrated in the dotted lines in FIG. 5) carries the data for slots 181 through 246.

At the end of the 180th slot, the upper band data is introduced from the shift register 102 alternately into a first eight-bit cosine register 108 and a second eight-bit sine register 110. In this case, it can be observed that a second two-position switch 112 is provided so that the even numbered slots are introduced into the eight-bit register 108, and that the odd numbered slots are introduced into the eight-bit register 110. At the end of every even slot, the square root of the sum of the squares of the content of the two registers 108 and 110 is extracted. This square root data corresponds to the high resolution upper band or "envelope" data. This data is summed in groups of six and the resulting sums are thereafter converted from a linear to a logarithmic scale by means of the lin-log converter 104.

By further reference to FIG. 5, it can be observed that the outputs of the cosine register and the sine register 110 are introduced into a circuit 114 which performs the extraction of the square root of the sum of the squares, as indicated above. This extraction process may be performed by a simple algorithim where the square root of the sum of the squares of the contents is approximately equal to the contents of one of the registers plus one-fourth of the content of the other register.

The output of the circuit 114 is introduced into a sum by sixes circuit 116 where each of the square root extractions is summed by six, and this output produces the data for slots 181 through 246. The summing by six operation merely includes the grouping of compoments into groups of six and summing the components of each group on a successive basis. Thus, a first group of six components is summed, the next group of six components to summed and so-on, until the entire transform has been created. In this case, it can be observed that a two-position switch 106 is provided at the input of the lin-log converter 104 so that the data for slots 1 through 180 can be introduced from the shift register 102, and the data for the slots 181–246 can be introduced through the sum of the sixes circuit 116.

A ten-bit synchronous code register 118 provides clock data to a parallel-to-serial converter 120 for information regarding the data of slots 247 through 256. Again, another two-position switch 122 is provided for selectively providing to an output, information for slots 1 through 246 or information from slots 247 through 256.

The lin-log converter 104 can be basically designed by the skilled artisan in a variety of forms with the given input-output relationships defined herein. However, in one configuration, the lin-log converter 104 may include a nine-bit shift register and a flip-flop where the eight-bit magnitude of an input data word is introduced into the register and the sign bit is entered into the flip-flop. The contents of this register may then be shifted at a clock rate, and the number of shifts required to move the most significant bit into the end position of the nine-bit register are counted in a three-bit counter. In this case, it is the number of shifts and not the contents of the register 100, and thus a three-bit counter may be employed. During slots 1–180, when the base band data is being processed, the contents of a three-bit register and the second and third most significant bits of the nine-bit register and the sign bit are transferred to a six-bit register. In this way, the contents of the six-bit register may then be clocked out in a serial format.

FIG. 7 illustrates one informational arrangement in accordance with the present invention and in which slots 1–180 are allocated to baseband data, slots 181–246 are allocated to upperband data and slots 247–256 are allocated to sync code information. The sync code is a typical code of sequences which is easily recognized and the band codes are straightforward digital representations of analog values. These codes, for example, may be essentially digital representations of those analog codes described in U.S. Pat. No. 3,403,227 to Robert Malm.

It should be observed that there are no sign bits associated with the upper band or so-called "envelope" data. Therefore, when the lin-log converter 104 is being used for upper band data during slots 181–246, the fourth most significant bit in the nine bit register may be transferred to the six-bit register instead of the sign bit. In this way, at the end of the 246th slot, all of the upper band data has been processed by the frame assembly unit 86. In this way spectrum contraction and expansion is achieved. The sync code contained in a ten-bit register 118 is read out serially during slots 247 through 256, in the manner as previously described.

D. Digital Vocoder Synthesizer

FIG. 6 of the drawings illustrates a modified form of vocoder synthesizer $S_2$ which operates on the principle of using purely digital techniques in order to synthesize digital information into an analog signal. The synthesizer $S_2$ generally comprises a 256-bit shift register 130, which receives digital information generally from a modem or similar digital transmission device. In this respect, the information received by the vocoder synthesizer $S_2$ may be transmitted from the vocoder analyzer $A_2$ in FIG. 3 of the drawings. In this case, the synthesizer $S_2$ would also include the necessary sync code recognition circuitry or in the synthesizer $S_1$ to establish frame and plot timming for the synthesizer $S_2$.

The information is introduced into the shift register 130 approximately at 9600 bits per second, and the data is thereupon subsequently transferred at a high data rate to a second shift register 132. By reference to FIG. 6, it can be observed that a two-position switch 134 is interposed between the two registers 130 and 132. One position of this two-position switch 134 will cover data for slots 1 through 254 and 256 whereas the other position of this switch will cover data for slot number 255. When the synthesizer $S_2$ is properly synchronized, the shift register 130 will contain one complete frame of data at the end of the 254th slot. The contents of this shift register 130 are then transferred to the shift register 132 during the time interval of the 255th slot.

The 255th slot, referring to the synthesizer of FIG. 6, is used to permit a shifting of information from the register 130 to the register 132. One complete frame of information is achieved at the end of the 254th slot. The information is transferred from the shift 130 to the shift register 132 during the period between the 254th slot to the 256th slot, namely the 255th slot, since there is a two slot offset with respect to the incoming data introduced into the register 130. The 255th slot is a unique slot which permits the shifting of the information from the shift register 130 to the shift register 132 as described.

The data contained in the shift register 132 is then transferred to a log-lin converter 136. The long-lin converter 136 is similar in many respects to the lin-log converter 104 as illustrated in FIG. 5 of the drawings. The actual design of the long-lin converter 136 would be obvious to the skilled artisan given the input, output relationships defined herein. Notwithstanding, any of a variety of converter designs could be employed in accordance with the present invention. The converter 136 is designed to return the serial input data back to a parallel output and thus converts the bits of each word to a parallel format output and to a linear scale. This conversion is used since the date is transmitted in serial format but operated on in parallel format since transmission of the information is used for convenience, but operation on the data is performed in parallel format for purposes of expediency.

The first three bits of any data word are clocked into a three-bit shift register and the fourth bit of this data word is clocked into a flip-flop. The fifth and sixth bits of a particular word are then clocked into an eight-bit shift register. As soon as the six input bits are loaded into the registers, a clock pulse will shift the contents of the eight-bit shift register to the right by a one-bit position and enter a binary "one" (corresponding to the most significant bit of the data word) into the vacated position. Subsequent clock pulses will shift the contents of the eight-bit shift register one position at a time until the total number of clock pulses recorded by a three-bit counter equals the number stored in the three-bit shift register. At this point, the contents of the eight-bit shift register and the flip-flop are transferred out in paralled.

A one-slot delay is introduced by the conversion process so that a frame of data which is introduced into the log-lin converter 136, beginning with the 256th slot, feeds out beginning with the first slot. The first 180 bits (thirty words) from the log-lin converter pertain to the baseband and are introduced directly into a Fourier transform unit including a digital multiplier 138, and a programmed read-only memory 140.

By further reference to FIG. 6, it can be observed that a two-position switch 142 is connected to the output of the log-lin converter 136 and in one of the positions will shift data for slots 1–30 whereas the other of the positions will shift the data for slots 31–256. Connected to the first of these positions for the data for slots 1–30 is a second two-position switch 144, the first position of which also covers data for slots 1–30 whereas the second covers the data for slots 31–256. When the two switches 142 and 144 are located in the positions as shown by the solid lines of FIG. 6, the data output of the log-lin converter 136 is introduced into the digitial multiplier 138. Sine and cosine information of the type described above is again supplied by the programmed read-only memory 140.

The output products of the digital multiplier 138 are introduced into an adder 146 where these products are added to the recirculating contents of a shift register 148 which is again sized to contain N′ words. In this respect, it can be observed that the output of the shift register 148 is connected through a two-position switch 150 to a recirculating feedback line 152, the output end of which is connected to the adder 146. In this respect the digital multiplier 138 and the programmed read-only memory 140, along with the adder 146 and the shift register 148, operate in a manner substantially identical to the digital multiplier 74, the read-only memory 76, the adder 78 and the shift register 80 in the analyzer $A_2$. Furthermore, the programmed read-only memory 140 is substantially identical to and operates in a manner similar to the programmed read-only memory 76, which is more fully illustrated in FIG. 4 of the drawings.

The output of the excitation synthesizer 152 is introduced into an upper band synthesizer 154 where the output of this synthesizer 154 is connected to the switch 144 so that data regarding slots 31–256 is provided when the movable element of the switch 144 is in the position as shown in the dotted lines of FIG. 6. It should also be observed that the output of the log-lin converter 136, which provides information for slots 31–256, is introduced into the upper band synthesizer 154 when the switch 142 is in the position as illustrated in the dotted lines of FIG. 6.

The function of the excitation synthesizer 152 is primarily designed to obtain the Fourier transform of the distorted baseband signal. The distortion of this baseband signal is accomplished by dropping all bits except one from each word which is supplied to the shift register 148. This excitation synthesizer 152 is essentially a Fourier transform device which is especially configured for the one-bit input data words which may be supplied to the shift register 148. The excitation synthesizer is similar in many ways to the previously described synthesizer. Since the input data is two-valued (plus one or minus one), the multiplication operation can be performed with an exclusive OR gate in which the incoming data bits are modulo-two added to the sign bit from the read-only memory 140.

The output words from the read-only memory 140 have signs modified in accordance with the input data, and are summed over slot periods. The sine coefficients are developed during oddnumbered slots and the cosine coefficients are developed during even-numbered slots. Approximately sixty-six analysis frequencies exist in the upper band which provides approximatly 132 Fourier transform coefficients to be calculated and therefore the computation ends at the 132nd slot. The results of the summation process are divided and transferred to the upper band synthesizer 154 during slots 32–163.

The actual synthesizer Fourier transform unit is comprised of the programmed read-only memory 40, the digital multiplier 138, the adder 146 and the shift register 148, along with the switch 150 and including the feedback line 152. The operations which are performed by the Fourier transform unit on the base band data are more fully outlined in the following Table III. In this case, 30 base band data points $X_1, X_2 \ldots X_{30}$ are assigned corresponding slot numbers as shown in the upper portion of Table III. The odd-numbered data points are the sine coefficients and the even-numbered data points are the cosine coefficients. In this case, for the center portion of Table III $X_{nm}$ and $C_{n,m}$ have the same representations as mentioned above in connection with Table II. In the lower portion of Table III, $n(o)$ represents $n$ summed over odd integers and $n(e)$ represents $n$ summed over even integers.

Considering the operations performed by the multiplier 138 during the nth slot, if it is assumed that $n$ is odd, the data point $X_n$ is a sine coefficient. Under these circumstances the programmed read-only memory 140 produces a sequence of 256 sine values, all of which are multiplied by $X_n$ as shown in the center portion of Table III with $n$ being odd. If $n$ is even, the data point $X_n$ is a cosine coefficient and the programmed read-only memory 140 produces a sequence of 256 cosine values, all of which are multiplied by $X_n$. The output products from the multiplier 138 are continually recirculated and summed in the adder-shift register combination so that at the end of the 30th slot, the contents of the shift register 148 are as shown in the lower portion of Table III.

TABLE III

| Slot | 1 | 2 | 3 | ... | n | ... | 30 | ... |
|---|---|---|---|---|---|---|---|---|
| Data Input | $X_1$ | $X_2$ | $X_3$ | ... | $X_n$ | ... | $X_{30}$ | ... |
| Slot | n | | | | | | | |
| Bin | 1 | 2 | 3 | .. | m | ... | 256 | |
| Sin/Cos Values n Odd | $s_{\frac{n+15}{2},1}$ | $s_{\frac{n+15}{2},2}$ | $s_{\frac{n+15}{2},3}$ | ... | $s_{\frac{n+15}{2},m}$ | ... | $s_{\frac{n+15}{2},256}$ | |
| n Even | $c_{\frac{n+14}{2},1}$ | $c_{\frac{n+14}{2},2}$ | $c_{\frac{n+14}{2},3}$ | ... | $c_{\frac{n+14}{2},m}$ | ... | $c_{\frac{n+14}{2},256}$ | |
| Mult Output n Odd | $X_n s_{\frac{n+15}{2},1}$ | $X_n s_{\frac{n+15}{2},2}$ | $X_n s_{\frac{n+1}{2},3}$ | ... | $X_n s_{\frac{n+15}{2},m}$ | ... | $X_n s_{\frac{n+15}{2},256}$ | |
| n Even | $X_n c_{\frac{n+14}{2},1}$ | $X_n c_{\frac{n+14}{2},2}$ | $X_n c_{\frac{n+14}{2},3}$ | | $X_n c_{\frac{n+14}{2},m}$ | | $X_n c_{\frac{n+14}{2},256}$ | |
| Slot | 30 | | | | | | | |
| Bin | 1 | 2 | 3 | ... | m | ... | 256 | |

TABLE III-continued

| | | | | | |
|---|---|---|---|---|---|
| Shift Register Contents | $\sum X_{n(o)} n^{S} \frac{n+15}{2}, 1$ | $\sum X_{n(o)} n^{S} \frac{n+15}{2}, 2$ | $\sum X_{n(o)} n^{S} \frac{n+15}{2}, 3$ | $\sum X_{n(o)} n^{S} \frac{n+15}{2}, m$ | $\sum X_{n(o)} n^{S} \frac{n+15}{2}, 256$ |
| | + | + | + | + | − |
| | $\sum X_{n(e)} n^{C} \frac{n+14}{2}, 1$ | $\sum X_{n(e)} n^{C} \frac{n+14}{2}, 2$ | $\sum X_{n(e)} n^{S} \frac{n+15}{2}, 3$ | $\sum X_{n(e)} n^{S} \frac{n+15}{2}, m$ | $\sum X_{n(e)} n^{S} \frac{n+15}{2}, 256$ |

The numbers in the shift register 148 can be recognized as the Fourier transform of the input data set, and are, therefore, the reconstructed samples of the baseband signal. The baseband signal data is read-out of the Fourier transform unit and particularly the shift register 148 during the slot 31 and into the excitation synthesizer 152. At the same time, data is reentered into the shift register 148 for temporary storage. There is no data to be processed by the Fourier transform unit during slots 31–45, and consequently, clocking during the Fourier transform unit stops during this period, except for the adder-shift register combination where clocking continues through the 31st slot.

The excitation synthesizer is more fully illustrated in FIG. 9 of the drawings and receives an input from the shift register 148 through the switch 154. In this case, it can be observed that the terminal of the switch designated as all other slots is introduced to a shift register 162 which is essentially a 256-bit shift register. The other position of the switch 154 which is the slot 31 position bypasses the shift register 162 in the manner as illustrated in FIG. 9 of the drawings. In essence, the incoming data (consisting of 256 bits) feeds into the 256-bit shift register 162 during slot 31. At the end of this slot, the switch is thrown to the other position and the same 256 bits are repeatedly read into an exclusive OR gate 164 during slots other than this slot 31.

The exclusive OR gate 164 has an output introduced into a summer 166 which is designed to sum by 256's. As indicated above, the input data contains 256 bits and the multiplication operation in the excitation synthesizer can be performed with the exclusive OR gate 164, and which incoming data bits are modulo -2 and added to a sine bit from a programmed read-only memory 168. The programmed read-only memory also has an absolute value signal introduced directly into the summer 166 in the manner as illustrated in FIG. 9. The output of the summer 166 is introduced into a divider 170 which is designed to divide by 128 and the output of the divider 170 is introduced directly into the upper band synthesizer 154.

As a specific example, the input to the exclusive OR gate 164 can have a bit rate of 2,457,600 bits per second and the input to the summer 66 from the OR gate can have a bit rate of 2,457,600 words per second. The output of the summer 166 which serves as an input to the devider 170 would have a rate of 9,600 words per second and the output of the divider 170 would also have an output of 9,600 words per second although the word format would be different.

The results of the exclusive OR operation, that is the operation performed with the exclusive OR gate 164, is shown in Table III in the line labeled "multiplier output". In this case, the programmed read-only memory 168 is essentially similar to the programmed read-only memory 140, except for a differential initial counter loading. The output words of the programmed read-only memory 168 with the signs modified in accordance with the input data are summed over slack periods as shown in the lower portion of Table III. The sine coefficients are developed during the odd numbered slots and cosine coefficients are developed during the even numbered slots. Since there are 66 analysis frequencies in the upper band and two times 66, or 132, Fourier coefficients to be calculated, the computation ends at the end of the 132nd slot. The results of the summation process as divided by the divider 170 (i.e., the binary point is shifted seven places to the left) and the resulting numbers are transferred as they are produced to the upper band synthesizer 154 during slots 32–163.

As indicated above, the function of the upper band synthesizer is to modify the excitation of Fourier coefficients in conformity with the upper band envelope data which is received from the lin-log convertor 136. The Fourier coefficients are introduced into an envelope extraction and smoothing circuit illustrated between the two input lines, that is the lines from the excitation synthesizer 152 and from the lin-log convertor 136, as illustrated in FIG. 10 of the drawings. In this case, the upper band synthesizer is substantially similar to the synthesizer used in the frame assembly unit.

The extraction smoothing circuit in the upper band snythesizer comprises a switch 172 which has an odd slots position 174 and an even slots position 176. The odd slots position 174 is introduced into an 8-bit register 178 capable of generating sine signals. The even slots position 176 has an input to an 8-bit register 180 designed to generate cousine signals. The output of each of these registers 178 and 180 is introduced into a circuit 182 which performs the square root of the sum of the squares of the two signals introduced therein. In addition, the output of the circuit 182 is introduced into a summer 184 which sums by sixes and the output of this summer 184 is introduced into a divider 186 which receives the input from the lin-log convertor 136. The input from the excitation synthesizer 152 is also introduced into a shift register 188, and the input thereof is introduced into a multiplier 190. This multiplier 190 also receives the output of the divider 186.

Considering the smoothing and envelope circuitry, the input from the excitation synthesizer will be at approximately 9,600 words per second, the the input of the square root circuitry 182 which performs the square rooting function will be 4,800 words per second. After this output from the circuitry 182 is summed by 6+s, the output of the summer 184 will be 800 words per second. In addition, the input from the lin-log converter 136 is 800 words per second, and notwithstanding, the output of the divider 186 is also 800 per second. In this way, after multiplication by the multiplier 190, the output is again 9,600 words per second. However, the output of the summer 184 and both the input and output of the divider 186 will have the decimal point shifted three places to the right.

The data supplied by the excitation synthesizer are the upper band Fourier coefficients for the distorted baseband signal. The function of the upper band synthesizer in this case is to modify the excitation Fourier coefficients in conformity with the upper band or envelope data received from the log-lin converter 136. The Fourier coefficients are introduced into envelope extraction and smoothing circuitry included in the upper band synthesizer, and this circuitry is similar to the circuitry used in the frame assembly unit 86. The smoothed envelope data pertains to the excitation spectrum and is divided into the upper band envelope data points supplied by the long-lin converter 136. The excitation data is introduced into the upper band synthesizer 154 at a time commencing with the 32nd slot. The computation of the smoothed envelope data will involve the input Fourier coefficient data contained in twelve slots, and therefore the excitation envelope data does not appear until the beginning of the 44th slot.

The shift register 132 has essentially been dormant since the 30th slot and is therefore restarted at the beginning of the 43rd slot so that the log-in converter 136 can provide upper band envelope data through the upper band synthesizer 154, and particularly to the divider thereof beginning with the 44th slot.

The output data words from the upper band synthesizer 154 are supplied to the multiplier 138 as previously described where they are multiplied by the Fourier coefficients of the excitation signal. The output from the multiplier is the synthesized upper band spectrum, which exits from the upper band synthesizer 154 at the beginning of the 46th slot. The synthetic upper band spectrum is Fourier transformed in the Fourier transform unit and is added to the Fourier transformed baseband spectrum which has been obtained during slots 1–30 and stored in the shift register 148 since the time of slot 31. The Fourier transform is complete at the end of the 177th slot and the results are clocked out of the shift register 148 and into a buffer shift register 156, during the 178th slot. The contents of the buffer shift register 156 are then shifted out over the next frame into an analog-to-digital converter 158.

The words which have been introduced into the analog-to-digital converter 158 from the buffer register 156 are converted into analog samples, and these samples are smoothed by means of a low pass filter 160. In this case, it can be recoginized that the output of the low pass filter is the synthesized input analog signal. Thus, if the input analog signal was a voice signal, then the output of the low pass filter 160 would be representative of the synthesized voice signal.

The coefficients $s_n$ and $b_n$ are derived from the sequence of values at the multipliers e.g. the multipliers 74 and 74' and 138, and the balanced modulators, e.g. the modulators 14, 16 and 52 and 54, in a relatively straightforward sequential multiplication. The values are logically and sequentially multiplied with, for example, 256 successive sample values of one cycle of a sine wave or a cosine wave, depending on which frequency corresponds to the numer of the slot.

The control logic which operates the various switches which, in turn, control the information introduced into the various slots, such as the switches 134, 142, etc., has not been shown in the drawings nor described herein, inasmuch as such control logic is quite obvious to the skilled artisan. Moreover, the control logic could be designed in any of a number of ways such that a switch is actuated when a slot receives a certain number of bits. For example, a simple binary element, such as a flip-flop in combination with counting logic, could be used for this purpose.

FIG. 11 illustrates the timing of the various signals in connection with the vocoder synthesizer of FIG. 6. IN this case, it can be observed that the frame as illustrated shows slots 254–256 of one frame and the beginning of a subsequent frame of slots 1 . . .

The timing diagram in FIG. 11 is essentially self-explanatory with reference to signals in the various components set forth in FIG. 6 of the drawings. The contents as read out of the shift register 130 is shown in FIG. 11 with respect to the contents of the input of the shift register 132. The data which is contained in the shift register 132 is illustrated in the signal in FIG. 11 (FIG. 3*c*) as introduced into the lin-log converter 136. It can be observed in connection with FIG. 11-F. The excitation data is shown in the form as illustrated, and which is read into the upper band synthesizer 154 and, in this case, the information begins with the 32nd slot. The computation of the smooth envelope data involves input Fourier coefficients contained in 12 slots and, consequently as stated above, the excitation envelope data appears at the beginning of the 4th slot. The lin-log converter 136 delivers the upper band envelope data to the upper band synthesizer 154 beginning with the 44th slot, as illustrated in FIG. 11-G. The output of the multiplier synthesized from the upper band spectrum which exits the upper band synthesizer 154 at the beginning of the 46th slot is also illustrated in FIG. 11-H. The Fourier transform is complete at the end of the 177th slot, and the results are fed out of the Fourier transform unit shift register in the 178th slot as shown in FIG. 11-I. Finally, the contents of the shift register 148 are shifted out over the next frame as shown in FIG. 11-J.

Thus, there has been illustrated and described novel vocoder systems including novel vocoder analyzers and vocoder synthesizers and which fulfill all of the objects and advantages sought therefor. Many changes, modifications, variations and other uses and applications of these vocoders and the methods of using the same, will become apparent to those skilled in the art after considering this specification and the accompanying drawings. Therefore, all such changes, modifications, variations and other uses and applications which do not depart from the spirit and scope of the invention are deemed to be covered by the invention which is limited only by the following claims.

I claim:

1. A vocoder system for generating a digital equivalent Fourier transform representative transmittable signals from an analog signal and reproducing an approximation of said analog signal therefrom, said system comprising:

a. input means for introducing an input analog signal having a broad frequency spectrum, b. digitizing means for generating digital equivalents representing certain of the frequencies in samples of frequencies in said broad frequency spectrum, c. summing means operatively associated with said digitizing means for selectively summing groups of a preselected number of N samples represented by said digital equivalents, d. first shift register means operatively connected to said summing means and receiving an output from said summing means for receiving and holding summed groups of digital equivalents of said N samples representing certain of the frequencies in said spectrum, e. recirculation means operatively connected across the output of said first shift register means and an input of said summing means for adding a sum of the digital equivalents in said first shift register means to new digital equivalents to be introduced to the input of said summing means, to thereby generate digital Fourier component representations of the Fourier transform from said input signals, f. receiving-synthesis means operatively connected to said first shift register means and recirculation means to receive the Fourier component digital representations of the Fourier transform from said input signal to recreate the Fourier components therefrom, g. second shift register means operatively connected to said receiving-synthesis means for holding the digital equivalents of said samples generated by said receiving-synthesis means, and h. conversion means operatively connected to said second shift register means for converting such digital equivalents representing the Fourier transform components to a synthesized analog signal form in which the frequencies in said synthesized analog signal approximate the frequencies in the frequency spectrum of the input analog signal introduced at said input means.

2. The vocoder system of claim 1 further characterized in that output means is operatively connected to said conversion means for providing said synthesized analog signal approximating the input analog signal.

3. The vocoder system of claim 1 further characterized in that recirculation means is operatively connected across an input and output of said second shift register means and is operatively associated with said conversion means.

4. The vocoder system of claim 1 further characterized in that said system comprises a vocoder analyzer and a vocoder synthesizer and wherein:

a. said vocoder analyzer comprises:
   1. the input means,
   2. the digitizing means operatively connected to said input means,
   3. the first shift register means operatively connected to the summing means and the digitizing means,
   4. the summing means having an output connected to the first shift register means, and
   5. the recirculation means connected across the summing means and first shift register means;

b. said vocoder synthesizer comprises:
   1. the receiving-synthesis means receiving an output from the vocoder analyzer,
   2. the second shift register means operatively connected to the receiving synthesis means, and
   3. the conversion means operatively connected to the second shift register means.

5. The vocoder system of claim 4 further characterized in that said vocoder analyzer comprises a pair of balanced modulators and a frequency synthesizer operatively interposed between and operatively connected to said input means and digitizing means and which aids in the generation of said samples of frequency, and that said vocoder synthesizer comprises a pair of balanced modulators and a frequency synthesizer operatively connected to said conversion means to aid in the regeneration of an analog signal approximating the analog input signal.

6. The vocoder system of claim 4 further characterized in that said vocoder analyzer comprises a first digitizing multiplier a first read-only memory operatively connected to the first digitizing multiplier, said multiplier and operatively connected to the input means and the summing means and read-only memory forming part of said digitizing means, and said vocoder synthesizer comprises a second digitizing multiplier operatively connected to said receiving-synthesis means and to said second shift register means, and a second read-only memory operatively connected to said second digitizing multiplier.

7. A vocoder system for generating digital equivalent Fourier transform representative transmittable signals from an analog signal and reproducing an approximation of said analog signal therefrom, said system comprising:

a. input means for introducing an input analog signal having a broad frequency spectrum, b. sampling means operatively connected to said input means for sampling the analog signal at preestablished time intervals and said sampling means including means for dividing the signal into a baseband portion and an upper band portion, c. digitizing means operatively connected to said sampling means for generating digital equivalents representing certain of the frequencies in said broad frequency spectrum in such manner that it is reproducible from said digital equivalents, d. processing means including a recirculatory storage member for processing the digital equivalents to generate digital Fourier component representations of a Fourier transform representing the input signal, e. receiving means to receive and extract the digital equivalents generated by said digitizing means, said storage member adding a sum of digital equivalents in the storage member to new digital equivalents a preselected number of times to generate the Fourier components, f. expanding means operatively connected to said receiving means to expand the baseband portion of the signal, g. combining means operatively connected to the expanding means for combining the baseband portion of the signal and the upperband portion of the signal, h. conversion means operatively connected to said combining means for processing the digital equivalents representing the Fourier transform components and converting such components of the combined baseband portion and upper band portion of the signal to a synthesized analog signal form, and i. output means operatively connected to said conversion means for providing said synthesized analog signal approximately the input analog signal.

8. The vocoder system of claim 7 further characterized in that said system comprises a vocoder analyzer and a vocoder synthesizer and wherein:

a. said vocoder analyzer comprises:
   1. the input means,
   2. the sampling means operatively connected to said input means and digitizing means, and
   3. the digitizing means receiving a signal from the input means as having an output to said sampling means;

b. said vocoder synthesizer comprises:
   1. the receiving means operatively connected to said processing means,
   2. the expanding means operatively connected to the receiving means,
   3. the combining means operatively connected to the expanding means,
   4. the conversion means operatively connected to the combining means, and 5. the output means operatively connected to the conversion means.

9. A vocoder analyzer for providing a wave form analysis using Fourier transform representative signals, said analyzer comprising:

a. input means for introducing an input analog signal having a broad frequency spectrum, b. sampling means operatively connected to said input means for sampling the analog signal at preestablished time intervals and forming samples representing a baseband portion and an upper band portion therefrom, c. digitizing means operatively connected to said sampling means for generating digital equivalents representing certain of the frequencies in said samples, d. shift register means operatively connected to said digitizing means to hold the samples of digital equivalents, e. summing means operatively connected to the digitizing means and shift register means for selectively summing groups of a preselected number of samples represented by said digital equivalents and storing such summed samples in said shift register means, and f. recirculation means operatively connected across an output of said shift register means and an input of said summing means for adding a sum of the digital equivalents from said shift register means to the new digital equivalents to be introduced to the input of said summing means, to thereby generate digital Fourier transform components representative of a Fourier transform of the input signal.

10. The vocoder analyzer of claim 9 further characterized in that said sampling means comprises a pair of balanced modulators and a frequency synthesizer operatively interposed between said input means and said summing means and which aids in the generation of said samples.

11. The vocoder analyzer of claim 9 further characterized in that said sampling means comprises a digitizing multiplexer and a read-only memory operatively interposed between the input means and the summing means and which forms part of said sampling means.

12. A vocoder synthesizer for providing wave form synthesis using Fourier transform representative signals, said system comprising:

a. receiving means for receiving Fourier transform digital equivalents approximating an analog signal having a broad frequency spectrum, b. synthesis means operatively forming part of said receiving means to receive the digital equivalents approximating a Fourier transform of said analog signal and to recreate samples of the Fourier components therefrom, c. shift register means operatively connected to said sampling means to hold samples of the Fourier transform digital equivalents, d. recirculation means operatively connected across an input and an output of said shift register means, e. switch means operatively associated with said recirculation means to select outputs of said register means to be introduced as inputs thereof or alternately select inputs to said register means from said synthesis means, f. summing means operatively connected to an input of said shift register means to selectively sum groups of samples of the digital equivalents, and g. recirculation means connected across an output of said shift register means and said summing means to recirculate an output of said shift register means to said summing means, h. conversion means operatively connected to said shift register means for receiving said equivalents representing the Fourier transform components and converting to a synthesized analog signal form in which the frequencies in said synthesized analog signal approximate the frequencies in frequency spectrum of the original analog signal.

13. The vocoder synthesizer of claim 12 further characterized in that said synthesizer comprises a pair of balanced modulators and a frequency synthesizer operatively connected to said conversion means to aid in the regeneration of an analog signal approximating the analog input signal.

14. The vocoder synthesizer of claim 12 further characterized in that said vocoder synthesizer comprises a read-only memory operatively connected to said conversion means.

15. A method for generating digital equivalent Fourier transform representative transmittable signals from an analog signal therefrom, said method comprising:

a. introducing an input analog signal have a broad frequency spectrum, b. creating samples of the frequencies in said broad frequency spectrum with samples of a baseband portion and an upper band portion and a sync portion, c. generating digital equivalents representing certain of the frequencies in said samples of frequencies in said broad frequency spectrum, d. selectively summing groups of a preselected number of N samples represented by said digital equivalents e. storing the summed samples in a shift register means and recirculating the stored summed samples and summing such samples with new samples for a preselected number of recirculations and summations to thereby generate digital Fourier transform component representations of the Fourier transform of the input signal, f. receiving the digital Fourier transform component representations of the Fourier transform from said input signal to recreate the Fourier transform component representations therefor, g. expanding the baseband portions of said signal, h. combining the baseband portions and the upper band portions of said signal, and i. converting such digital equivalents representing the Fourier transform components in said portions to a synthesized analog signal form in which the frequencies in said synthesized analog signal approximate the frequencies in the frequency spectrum of the input analog signal introduced at said input means.

16. A vocoder system for generating digital equivalent Fourier transform representative transmittable signals from an analog signal and reproducing an approximation of said analog signal thereform, said system comprising:

a. input means for introducing an input analog signal having a broad frequency spectrum, b. sampling means operatively connected to said input means for sampling the analog signal at preestablished time intervals and dividing the signal into a baseband portion and an upper band portion, c. digitizing means operatively connected to said sampling means for generating digital equivalents representing certain of the frequencies in said broad frequency spectrum in such manner that it is reproducible from said digital equivalents, d. first shift register means and first summing means operatively connected to said digitizing means, e. first recirculation means operatively connected across an output of said first shift register means and an input of said first summing means for adding a sum of the digital equivalents in said shift register means to the new digital equivalents to be introduced to the input of said first summing means to thereby generate digital Fourier transform component representations of the Fourier transform of the input signal, f. receiving means to receive and extract the digital equivalents generated by said digitizing means, g. expanding means operatively connected to said receiving means to expand the baseband portion of the signal, h. combining means for combining the baseband portion of the signal and the upperband portion of the signal, i. conversion means operatively connected to said combining means for converting digital equivalents of the combined baseband portion and upper band portion of the signal to a synthesized analog signal form, j. second shift register means and second summing means operatively connected to said conversion means, k. second recirculation means operatively connected across an output of said second shift register means and an input of said second summing means operatively associated with said conversion means for extracting and summing groups of the digital equivalents representing the digital Fourier transform component representations and recreating an approximation of said input signal, and output means operatively connected to said conversion means for providing a synthesized analog signal from the Fourier transform component representations approximating the input analog signal.

17. A vocoder analyzer for providing a wave form analysis using Fourier transform representative signals, said analyzer comprising:

a. input means for introducing an input analog signal having a broad frequency spectrum, b. sampling means including a pair of balanced modulators and a frequency synthesizer operatively connected to said input means for sampling the analog signal at pre-established time intervals and forming samples representing a baseband portion and an upper band portion therefrom, c. digitizing means operatively connected to said balanced modulators and frequency synthesizer of said sampling means for generating digital equivalents representing certain of the frequencies in said samples, d. recirculating register means operatively associated with said digitizing means to hold the samples of digital equivalents, and e. summing means operatively associated with the digitizing means and register means for selectively summing groups of samples represented by said digital equivalents from said register means and reintroducing samples summed with new samples back into said register means for a predetermined number of times to thereby generate digital Fourier transform components representative of a Fourier transform of the input signal.

18. A vocoder analyzer of claim 17 further characterized in that said recirculating register means is a shift register means which stores the summed samples, and the recirculating portion of said register means constitutes a recirculation means which is operatively connected across an output of said shift register means and an input of said summing means for adding a sum of the digital equivalents from said shift register means to the new digital equivalents to be introduced to the input of said summing means, to thereby generate digital Fourier transform components representative of a Fourier transform of the input signal.

19. A vocoder analyzer for providing a wave form analysis using Fourier transform representative signals, said analyzer comprising:

a. input means for introducing an input analog signal having a broad frequency spectrum, b. sampling means including a digitizing multiplier and a read-only memory operatively connected to said input means for sampling the analog signal at pre-established time intervals and forming samples representing a baseband portion and an upper band portion therefrom, c. digitizing means operatively connected to said sampling means for generating digital equivalents representing certain of the frequencies in said samples, d. recirculating register means operatively associated with said digitizing means to hold the samples of digital equivalents, and e. summing means operatively associated with the digitizing means and shift register means for selectively summing groups of samples represented by said digital equivalents from said register means and reintroducing summed samples with new samples summed therewith back into said register means for a predetermined number of times to thereby generate digital Fourier transform components representative of a Fourier transform of the input signal.

20. The vocoder analyzer of claim 19 further characterized in that said recirculating register means is a shift register means which stores the summed samples, and the recirculating portion of said register means constitutes a recirculation means which is operatively connected across an output of said shift register means and an input of said summing means for adding a sum of the digital equivalents from said shift register means to the new equivalents to be introduced to the input of said summing means, to thereby generate digital Fourier transform components representative of a Fourier transform of the input signal.

21. A vocoder system for generating digital equivalent Fourier transform representative transmittable signals from an analog signal and reproducing an approximation of said analog signal therefrom, said system comprising:

a. input means for introducing an input analog signal having a broad frequency spectrum, b. sampling means operatively connected to said input means for dividing the frequencies in said spectrum into samples of a baseband portion and an upper band portion and a sync code portion, c. digitizing means operatively connected to said sampling means for generating digital equivalents representing certain of the frequencies in samples of frequencies in said broad frequency spectrum, d. summing means operatively associated with said digitizing means for selectively summing a preselected number of groups of N samples of said portions represented by said digital equivalents, e. first shift register means operatively connected to and receiving an input from said summing means for receiving and holding summed groups of digital equivalents of said N samples representing certain of the frequencies in said spectrum, f. first recirculation means operatively connected across the output of said first shift register means and an input of said summing means for adding a sum of the digital equivalents in said first shift register means to new digital equivalents to be introduced to the input of said summing means, to thereby generate digital Fourier component representations of the Fourier transform from said input signal, g. receiving-synthesis means to receive the Fourier component digital representations of the Fourier transform from said input signal to recreate the Fourier components therefrom and forming samples of digital equivalents of the baseband portion and the upper band portion and the sync portion, h. second shift register means operatively connected to said receiving-synthesis means for holding the digital equivalents of said samples generated by said receiving-synthesis means, i. recirculation means operatively connected across said second shift register means, and j. conversion means operatively connected to said second shift register means for converting such digital equivalents representing the Fourier transform components to a synthesized analog signal form in which the frequencies in said synthesized analog signal approximate the frequencies in the frequency spectrum of the input analog signal introduced at said input means.

* * * * *